US010941942B2

(12) United States Patent
Freeman et al.

(10) Patent No.: US 10,941,942 B2
(45) Date of Patent: Mar. 9, 2021

(54) RETENTION SYSTEM FOR GAS TURBINE ENGINE ASSEMBLIES

(71) Applicants: Rolls-Royce North American Technologies, Inc., Indianapolis, IN (US); Rolls-Royce High Temperature Composites Inc., Cypress, CA (US)

(72) Inventors: Ted J. Freeman, Danville, IN (US); Wayne S. Steffier, Huntington Beach, CA (US)

(73) Assignees: Rolls-Royce North American Technologies Inc., Indianapolis, IN (US); Rolls-Royce High Temperature Composites Inc., Cypress, CA (US)

( * ) Notice: Subject to any disclaimer, the term of this patent is extended or adjusted under 35 U.S.C. 154(b) by 1494 days.

(21) Appl. No.: 14/971,535

(22) Filed: Dec. 16, 2015

(65) Prior Publication Data

US 2016/0186999 A1 Jun. 30, 2016

Related U.S. Application Data

(60) Provisional application No. 62/098,543, filed on Dec. 31, 2014.

(51) Int. Cl.
*F23R 3/60* (2006.01)
*F01D 25/28* (2006.01)
(Continued)

(52) U.S. Cl.
CPC ..... *F23R 3/60* (2013.01); *F01D 11/08* (2013.01); *F01D 25/246* (2013.01); *F01D 25/28* (2013.01);
(Continued)

(58) Field of Classification Search
CPC . F01D 11/08; F01D 25/28; F01D 9/04; F01D 25/246; F05D 2240/90; F05D 2240/10; F05D 2260/30; F23R 3/60
See application file for complete search history.

(56) References Cited

U.S. PATENT DOCUMENTS 4,975,014 A 12/1990 Rufin et al.
5,090,857 A 2/1992 Dunn
(Continued)

FOREIGN PATENT DOCUMENTS

EP 1350927 A2 10/2003
EP 1398516 A1 3/2004
(Continued)

OTHER PUBLICATIONS

Klosterman "Automated Fabrication of Monolithic and Ceramic Matrix Composites" (Year: 1997).*
(Continued)

*Primary Examiner* — Gerald L Sung
*Assistant Examiner* — William L Breazeal
(74) *Attorney, Agent, or Firm* — Barnes & Thornburg LLP

(57) ABSTRACT

A combustor of a gas turbine engine and a turbine shroud for a turbine of a gas turbine engine are disclosed. The combustor is configured to ignite a mixture of compressed air and fuel in a combustion chamber included therein. The turbine shroud is configured to direct products of the combustion reaction toward a plurality of rotatable turbine blades of the turbine to cause the plurality of turbine blades to rotate.

16 Claims, 4 Drawing Sheets

(51) Int. Cl.

| | |
|---|---|
| ***F23R 3/00*** | (2006.01) |
| ***F01D 11/08*** | (2006.01) |
| ***F01D 25/24*** | (2006.01) |

(52) U.S. Cl.

CPC ..... *F23R 3/002* (2013.01); *F23R 3/007* (2013.01); *F05D 2260/30* (2013.01); *F23R 2900/00017* (2013.01)

(56) References Cited

U.S. PATENT DOCUMENTS

| | | | | |
|---|---|---|---|---|
| 5,592,814 | A | 1/1997 | Palusis et al. | |
| 5,632,598 | A * | 5/1997 | Maier | F01D 5/225 415/173.5 |
| 6,223,538 | B1 | 5/2001 | Benz et al. | |
| 6,397,765 | B1 | 6/2002 | Becker et al. | |
| 6,612,248 | B2 | 9/2003 | Becker | |
| 7,665,307 | B2 | 2/2010 | Burd et al. | |
| 7,988,395 | B2 | 8/2011 | Steffier | |
| 2007/0031258 | A1 * | 2/2007 | Campbell | F01D 9/04 416/189 |
| 2010/0189529 | A1 * | 7/2010 | Steffier | F16B 3/00 411/368 |
| 2011/0268495 | A1 | 11/2011 | Heide | |
| 2011/0271684 | A1 | 11/2011 | Corsmeier et al. | |
| 2013/0019603 | A1 | 1/2013 | Dierberger et al. | |
| 2014/0360196 | A1 | 12/2014 | Graves et al. | |

FOREIGN PATENT DOCUMENTS

| | | | |
|---|---|---|---|
| GB | 881880 | * | 5/1960 |
| WO | 2014163674 | A1 | 10/2014 |

OTHER PUBLICATIONS

Extended European Search Report, European Application No. 15200303.4, dated Apr. 19, 2016, 9 pages.

* cited by examiner

RETENTION SYSTEM FOR GAS TURBINE ENGINE ASSEMBLIES

CROSS REFERENCE TO RELATED APPLICATIONS

This application claims priority to and the benefit of U.S. Provisional Patent Application No. 62/098,543, filed Dec. 31, 2014, the disclosure of which is now expressly incorporated herein by reference.

FIELD OF THE DISCLOSURE

The present disclosure relates generally to gas turbine engines, and more specifically to retention systems used in gas turbine engines.

BACKGROUND

Gas turbine engines typically include a compressor, a combustor, and a turbine. The compressor compresses air drawn into the engine and delivers high pressure air to the combustor. In the combustor, fuel is mixed with the high pressure air and the air/fuel mixture is ignited. Products of the combustion reaction in the combustor are directed into the turbine where work is extracted to drive various components of the gas turbine engine.

Gas turbine engine efficiency is maximized by increasing a maximum operating temperature of the gas turbine engine components. The maximum operating temperature of metallic or superalloy gas turbine engine components are limited compared to the maximum operating temperature of gas turbine engine components formed from other materials. For instance, gas turbine engine components formed from Ceramic Matrix Composite (CMC) materials are operable at higher temperatures than gas turbine engine components formed from metallic or superalloy materials. Incorporating CMC materials into gas turbine engines may be challenging because traditional fasteners and retention systems are sometimes difficult to incorporate into assemblies of metallic and CMC components.

SUMMARY

The present disclosure may comprise one or more of the following features and combinations thereof.

A turbine shroud may comprise a carrier, a blade track segment, and a retention system. The carrier may be made of metal and formed to include an aperture. The blade track segment may be made of ceramic matrix composite material and arranged adjacent to the metallic carrier. The blade track segment may include a runner adapted to extend around a portion of an axis, and a stud formed in one-piece with the runner that extends radially outward from the runner through the aperture formed in the carrier. The retention system may be adapted to couple the blade track segment to the carrier. The retention system may include a pair of threaded stud receivers that capture a portion of the stud arranged outside of the aperture to block movement of the stud out of the aperture, and a nut that engages the threaded stud receivers to block release of the stud from the stud receivers.

In some embodiments, the stud may include a neck that extends through the aperture and a first barb arranged outside the aperture opposite the runner. Each of the threaded stud receivers may be formed to include a cutout having a shape complementary to about half of the first barb, and the pair of stud receivers may be arranged with the cutouts in confronting relation so that the cutouts receive the first barb and the pair of stud receivers block movement of the stud out of the aperture. In some embodiments, the first barb may extend radially outward from the neck to form a retention surface that faces radially inward toward the axis. The retention surface may extend from the neck at a generally constant distance from the runner. Additionally, in some embodiments, the first barb may extend axially outward from the neck to form a retention surface that faces radially inward toward the axis. The retention surface may extend from the neck at a generally constant distance from the runner.

In some embodiments, the carrier may be formed to include a second aperture, the blade track segment may include a second stud formed in one-piece with the runner that extends radially outward from the runner parallel to the stud through the second aperture formed in the carrier, and the second stud may be circumferentially spaced apart from the stud about the axis. The stud and the second stud may be sized relative to their respective apertures to allow the stud and the second stud to move within their respective apertures so that the blade track segment is movable relative to the carrier.

According to another aspect of the present disclosure, a combustor may include a shell, a liner tile, and a retention system. The shell may be made of metal and formed to include an aperture. The liner tile may be made of ceramic matrix composite material and arranged adjacent to the shell. The liner tile may be adapted to extend around a portion of an axis, and the liner tile may include a tab and a stud formed in one-piece with the tab that extends radially outward from the tab through the aperture formed in the shell. The retention system may be adapted to couple the liner tile to the shell. The retention system may include a pair of threaded stud receivers that capture a portion of the stud arranged outside of the aperture to block movement of the stud out of the aperture, and a nut that engages the threaded stud receivers to block release of the stud from the stud receivers.

In some embodiments, the stud may include a neck that extends through the aperture and a first barb arranged outside of the aperture opposite the tab. Each of the threaded stud receivers may be formed to include a cutout having a shape complementary to about half of the first barb, and the pair of stud receivers may be arranged with the cutouts in confronting relation so that the cutouts receive the first barb and the pair of stud receivers block movement of the stud out of the aperture. In some embodiments, the first barb may extend both radially and axially outward from the neck to form a retention surface that faces radially inward toward the axis. The retention surface may extend from the neck at a generally constant distance from the tab. Additionally, in some embodiments, the retention surface may extend over the tab generally parallel to the axis. In some embodiments still, the retention surface may be generally tangent to a circle extending around the axis.

In some embodiments, the shell may be formed to include a second aperture, the liner tile may include a second stud formed in one-piece with the tab that extends radially outward from the tab parallel to the stud through the second aperture formed in the shell, and the second stud may be circumferentially spaced apart from the stud about the axis. The second stud may include a neck that extends through the second aperture and a barb arranged outside the second aperture opposite the tab, and the barb may extend radially outward from the neck to form a retention surface that faces radially inward toward the axis.

According to yet another aspect of the present disclosure, a method for assembling a turbine shroud may include arranging a blade track segment of a blade track formed from ceramic matrix composite material relative to a metallic carrier segment so that a first stud formed in one-piece with a runner of the blade track segment extends through a first aperture formed in the metallic carrier segment and a second stud formed in one-piece with the runner of the blade track segment extends through a second aperture formed in the metallic carrier segment, and engaging (i) a first pair of threaded stud receivers with opposite sides of the first stud so that the first stud is received in cutouts formed in each stud receiver of the first pair of threaded stud receivers to block movement of the first stud out of the first aperture and (ii) a second pair of threaded stud receivers with opposite sides of the second stud so that the second stud is received in cutouts formed in each stud receiver of the second pair of threaded stud receivers to block movement of the second stud out of the second aperture.

In some embodiments, the method may include securing (i) a first nut around the first pair of threaded stud receivers to block release of the first stud from the first pair of threaded stud receivers, and (ii) a second nut around the second pair of threaded stud receivers to block release of the second stud from the second pair of threaded stud receivers.

These and other features of the present disclosure will become more apparent from the following description of the illustrative embodiments.

DETAILED DESCRIPTION OF THE DRAWINGS

Figure 1:
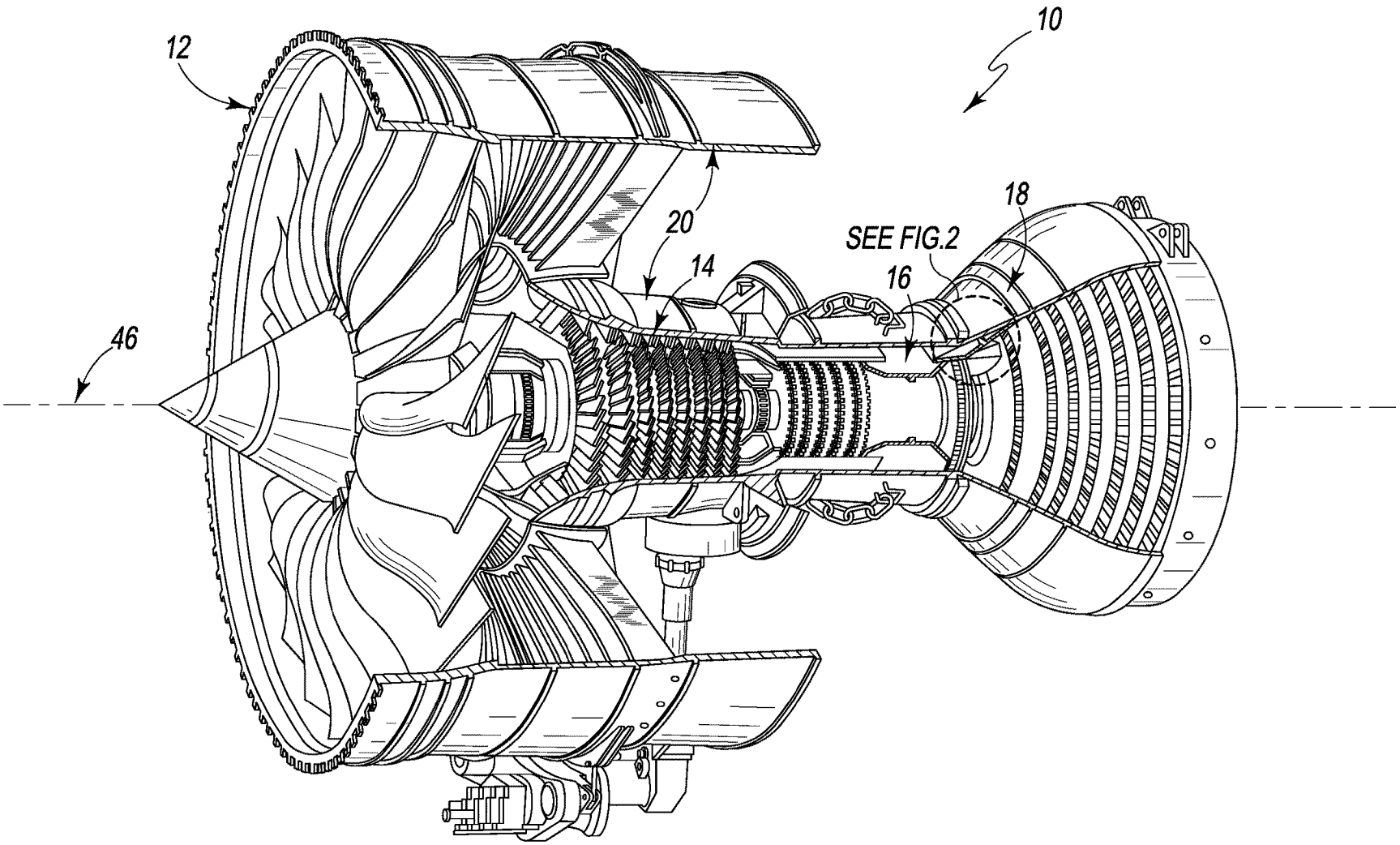
FIG. 1 is a cut-away perspective view of a gas turbine engine.

For the purposes of promoting an understanding of the principles of the disclosure, reference will now be made to a number of illustrative embodiments illustrated in the drawings and specific language will be used to describe the same.

Referring now to FIG. 1, a cut-away view of an illustrative aerospace gas turbine engine 10 is shown. The gas turbine engine 10 includes a fan 12, a compressor 14, a combustor 16, and a turbine 18, each of which is surrounded and supported by a metallic case 20. The compressor 14 compresses and delivers air to the combustor 16. The combustor 16 mixes the compressed air with fuel, ignites the air/fuel mixture, and delivers the combustion products (i.e., hot, high-pressure gases) to the turbine 18. The turbine 18 converts the combustion products to mechanical energy (i.e., rotational power) that drives, among other things, the fan 12 and the compressor 14.

Figure 2:
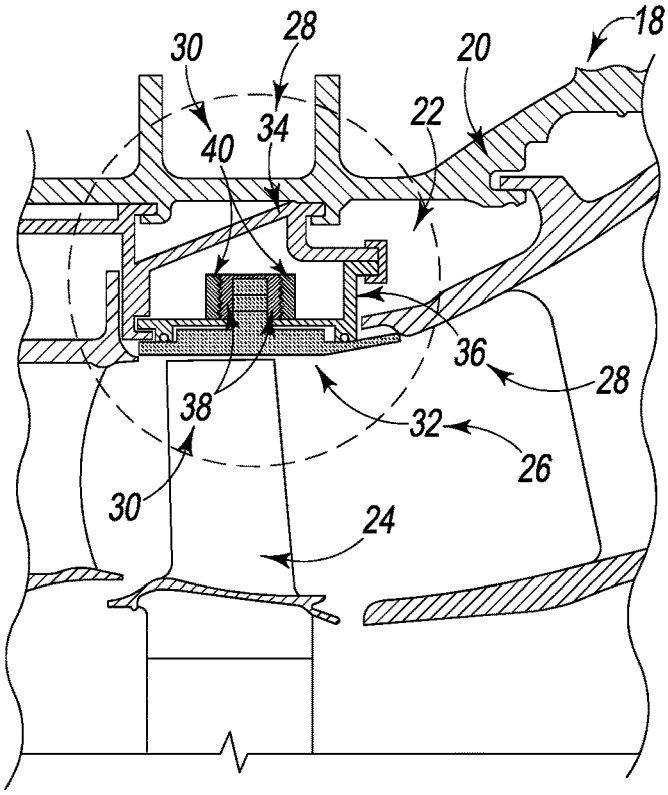
FIG. 2 is a sectional view of a portion of a turbine included in the gas turbine engine of FIG. 1.

Referring now to FIG. 2, a portion of the turbine 18 is shown to include a turbine shroud assembly 22. The turbine shroud assembly 22 blocks combustion products delivered to the turbine 18 from the combustor 16 from passing over a plurality of rotatable blades 24 included in the turbine 18 without causing the plurality of blades 24 to rotate. The turbine shroud assembly 22 illustratively includes a turbine blade track 26, a metallic carrier 28, and a retention system 30.

The turbine blade track 26 of the turbine shroud assembly 22 extends circumferentially to surround the plurality of turbine blades 24 to block combustion products delivered to the turbine 16 from passing over the turbine blades 24. Combustion products allowed to pass over the blades 24 do not cause the blades 24 to rotate, thereby contributing to lost performance within the engine 10. The turbine blade track 26 includes a plurality of blade track segments 32 as discussed below with regard to FIGS. 2-4.

The metallic carrier 28 of the turbine shroud assembly 22 is coupled to the metallic case 20 and the turbine blade track 26 as shown in FIG. 2. The metallic carrier 28 extends circumferentially to surround the turbine blade track 26 and to support the blade track 26 relative to the case 20 as shown in FIG. 2. The metallic carrier 28 includes a segmented outer carrier 34 and a segmented inner carrier 36 coupled to the outer carrier 34.

The retention system 30 incorporated into the turbine shroud assembly 22 is adapted to couple the plurality of blade track segments 32 to the inner carrier 36 of the carrier 28. The retention system 30 illustratively includes, for each blade track segment 32, two pairs of threaded stud receivers 38 (best seen in FIG. 4) that are configured to engage a portion of the blade track segment 32, and nuts 40 (also best seen in FIG. 4) that are configured to engage the threaded stud receivers 38 to block release of the portion of the blade track segment 32 from the threaded stud receivers 38.

Figure 3:
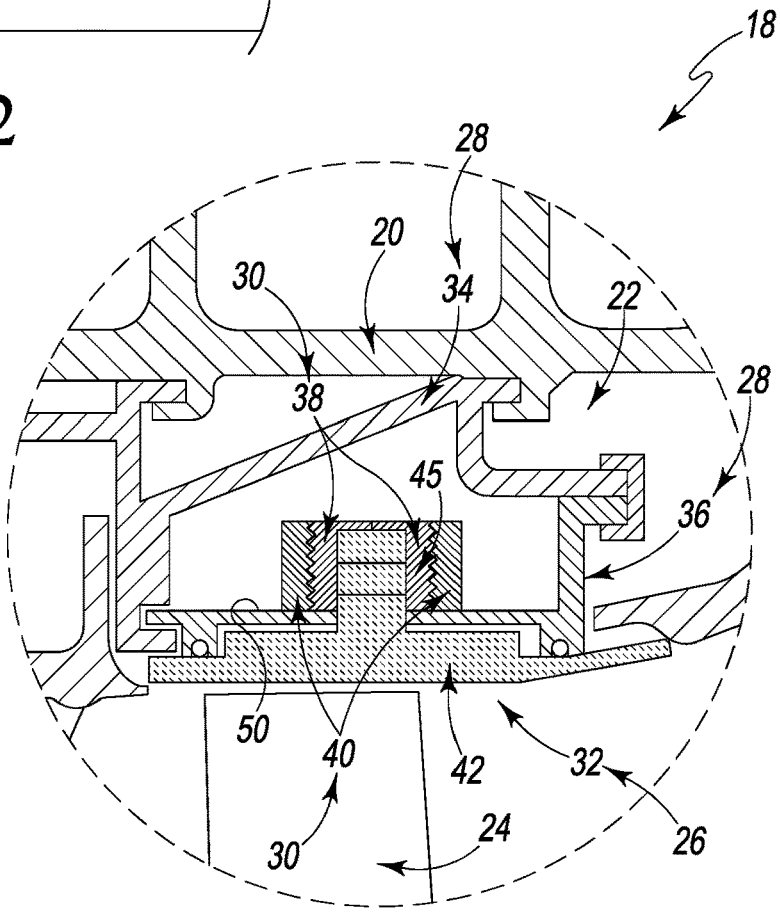
FIG. 3 is a detail view of the portion of the turbine of FIG. 2 showing that the turbine includes a retention system for holding composite blade tracks in place relative to a metallic carrier.

Referring now to FIG. 3, a detail view of the turbine 18 of FIG. 2 is shown. Each of the blade track segments 32 illustratively includes an arcuate runner 42 and a pair of studs 44 formed in one-piece with the runner 42 (best seen in FIG. 4). The runner 42 is adapted to extend around a portion of an axis 46 extending longitudinally through the gas turbine engine 10 (see FIG. 1), and the pair of studs 44 extend radially outward from the arcuate runner 42 away from the axis 46 as shown in FIG. 3. In the illustrative embodiment, each of the blade track segments 32 is illustratively constructed of a ceramic matrix composite material. In one example, the ceramic matrix composite material may include silicon-carbide fibers formed into fabric sheets and a silicon-carbide matrix. In another example, the ceramic matrix composite material may include another ceramic-based material that including reinforcing fibers and a matrix material.

Though each blade track segment 32 is shown to include two studs 44 in the illustrative embodiment, more or less than two studs 44 may be included in each blade track segment 32 in other embodiments. In some embodiments, for example, each blade track segment 32 may include one stud 44. In other embodiments, each blade track segment 32 may include three studs 44 arranged, for example, in a triangular configuration. In other embodiments still, each blade track segment 32 may include four studs 44.

Figure 4:
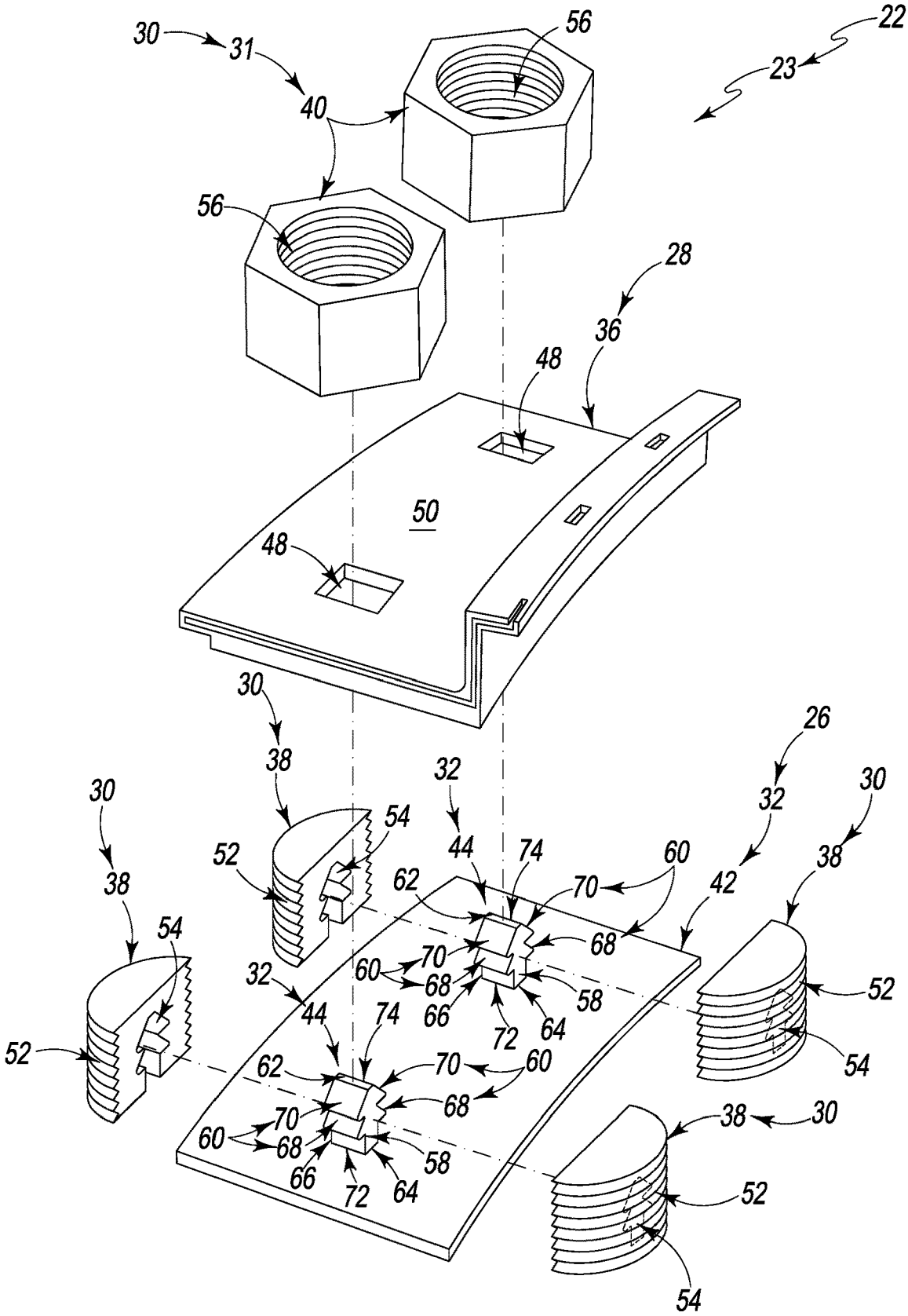
FIG. 4 is a perspective assembly view of a portion of a turbine shroud included in the turbine of FIG. 2 showing the components of the retention system.

Each segment of the inner carrier 36 of the metallic carrier 28 is formed to include apertures 48 (best seen in FIG. 4)

that are sized to receive the pair of studs 44 of each blade track segment 32 as shown in FIG. 3. When the blade track segment 32 is arranged adjacent the inner carrier 36 as shown in FIG. 3, the pair of studs 44 extend through the apertures 48 and beyond the inner carrier 36 toward the outer carrier 34. The retention system 30 is positioned between the inner carrier 36 and the outer carrier 34 as shown in FIG. 3.

Each pair of threaded stud receivers 38 of the retention system 30 captures a portion 45 of one of the studs 44 arranged outside of one of the apertures 48 as shown in FIG. 3. In this way, the threaded stud receivers 38 block movement of the studs 44 out of the apertures 48. The nuts 40 engage and surround the threaded stud receivers 38 to block release of the studs 44 from the threaded stud receivers 38. The threaded stud receivers 38 and the nuts 40 engage a surface 50 of the inner carrier 36 that faces radially outward away from the axis 46 when the retention system 30 is positioned between the outer and inner carriers 34, 36. The threaded stud receivers 38 and the nuts 40 extend beyond the studs 44 relative to the surface 50 as shown in FIG. 3.

In other embodiments, each of the blade track segments 32 may be formed to include more or less than the two studs 44. Therefore, in those embodiments, the number of threaded stud receivers 38 and nuts 40 included in the retention system 30 may vary according to the number of studs 44 included in each of the blade track segments 32.

Referring now to FIG. 4, a perspective assembly view of one segment 23 of the turbine shroud assembly 22 is shown. The segment 23 of the turbine shroud assembly 22 includes one of the blade track segments 32, one of the inner carrier segments 36, and components 31 of the retention system 30.

The studs 44 of the blade track segment 32 are illustratively circumferentially spaced apart from one another about the axis 46, and the studs 44 extend radially outward away from the axis 46 parallel to one another. The apertures 48 of the inner carrier segment 36 are circumferentially spaced apart from one another about the axis 46 to receive the studs 44.

The threaded stud receivers 38 are formed to include external threads 52 and cutouts 54 having shapes complementary to the studs 44, and the stud receivers 38 are arranged in confronting relation so that the cutouts 54 receive the studs 44 (i.e., each cutout 54 receives approximately one half of each stud 44). Each of the nuts 40 is sized to receive the pair of threaded stud receivers 38 so that internal threads 56 of the nuts 40 engage the external threads 52 of the pair of stud receivers 38.

The apertures 48 of the inner carrier segment 36 may be sized to permit the studs 44 to move within the apertures 48 to a limited extent when the studs 44 are received in the apertures 48 as suggested in FIG. 4. As such, the blade track segment 32 and the portion 31 of the retention system 30 coupled thereto may be movable relative to the inner carrier segment 36 to the extent that the studs 44 are movable within the apertures 48. In other embodiments, however, the apertures 48 may be sized to resist or substantially prevent the studs 44 from moving within the apertures 48 when the studs 44 are received in the apertures 48.

Each stud 44 of the blade track segment 32 illustratively includes a neck 58, a plurality of barbs 60, and a substantially planar roof 62 as shown in FIG. 4. When the blade track segment 32 is arranged adjacent the inner carrier segment 36 to assemble the segment 23 of the turbine shroud assembly 22, the neck 58 extends through the aperture 48 and the portion 45 of the stud 44 (i.e., a portion of the neck 58, the plurality of barbs 60, and the roof 62) is arranged outside the aperture 48 opposite the runner 42 as suggested in FIG. 4. As shown in FIG. 4, each aperture 48 is sized to permit the neck 58 of each stud 44 to move within the aperture 48.

The plurality of barbs 60 of each stud 44 are spaced apart from the runner 42, and the plurality of barbs 60 extend over the runner 42 substantially parallel to the axis 46 between a first end 64 and second end 66 opposite the first end 64 as shown in FIG. 4. When the studs 44 are received in the threaded stud receivers 38, about half of each one of the plurality of barbs 60 is received in each of the cutouts 54 of the threaded stud receivers 38. The plurality of barbs 60 illustratively includes four barbs. In other embodiments, the plurality of barbs 60 may include more or less than four barbs.

In the illustrative embodiment, the neck 58, the plurality of barbs 60, and the roof 62 of each stud 44 of each blade track segment 32 extend substantially parallel to the axis 46 (i.e., in the axial direction) as shown in FIG. 4. In other embodiments, the studs 44 may be arranged relative to the runner 42 so that the neck 58, the plurality of barbs 60, and the roof 62 of each stud 44 of each blade track segment 32 extend in the circumferential direction (i.e., the studs 44 are rotated 90 degrees clockwise or counterclockwise relative to the runner 42 compared to the arrangement shown in FIG. 4).

The plurality of barbs 60 of each stud 44 illustratively includes a first pair of barbs 68 and a second pair of barbs 70 arranged beyond the first pair of barbs relative 68 to the neck 58. Each of the first and second pairs of barbs 68, 70 are arranged on opposite sides 72, 74 of the studs 44. Each of the first and second pairs of barbs 68, 70 extends radially outward from the neck 58 in substantially the same direction. Each of the first and second pairs of barbs 68, 70 extends axially outward from the neck 58 in opposite directions.

Using one of the first pair of barbs 68 as an example, the barb 68 extends radially outward and axially outward from the neck 58 as indicated above to form a retention surface 76 that faces radially inward toward the axis 46. Each of the other barbs 60 forms a similar retention surface 76. When the studs 44 are received in the threaded stud receivers 38, the retention surfaces 76 engage corresponding surfaces of the threaded stud receivers 38 so that the studs 44 are at least partially retained by the stud receivers 38.

The retention surface 76 extends over the runner 42 from the neck 58 and between the ends 64, 66 at a generally constant distance from the runner 42 as shown in FIG. 4. In this way, the retention surface 76 extends over the runner 42 generally parallel to the axis 46, and the retention surface 76 is generally tangent to a circle (not shown) extending around the axis 46.

In other embodiments, the studs 44, and the corresponding cutouts 54 formed in the threaded stud receivers 38, may take the form of other suitable shapes. For instance, the studs 44 and the cutouts 54 may include generally sinusoidal or wave-like shapes or features. The shapes of the studs 44 and the cutouts 54 may be selected to minimize stress concentrations in portions of each of the segments 23 of the shroud assembly 22 during operation of the engine 10, such as the studs 44 and the runner 42 of each segment 23, for example.

Referring to FIGS. 1-4, a method of assembling the turbine shroud assembly 22 includes arranging one of the blade track segments 32 relative to one of the segments of the inner carrier 36 so that one of the studs 44 extends through one of the apertures 48 and the other one of the studs 44 extends through the other of the apertures 48, and engaging (i) one of the pairs of threaded stud receivers 38 with the sides 72, 74 of the one stud 44 so that the one stud 44 is received in the cutouts 54 to block movement of the one stud 44 out of the one aperture 48 and (ii) the other of the pairs of threaded stud receivers 38 with the sides 72, 74 of the other stud 44 so that the other stud 44 is received in the cutouts 54 to block movement of the other stud 44 out of the other aperture 48.

Figure 5:
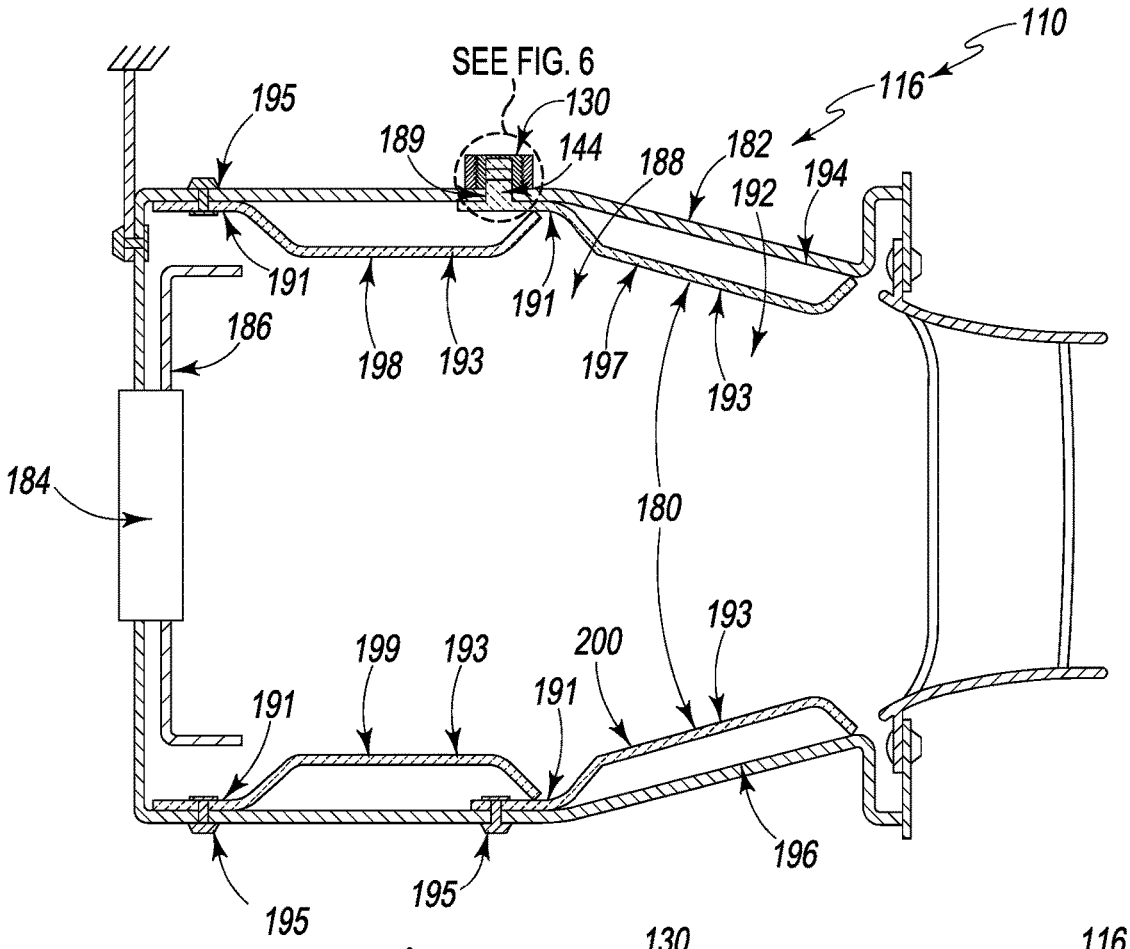
FIG. 5 is a sectional view of a combustor included in another embodiment of a gas turbine engine.
Figure 6:
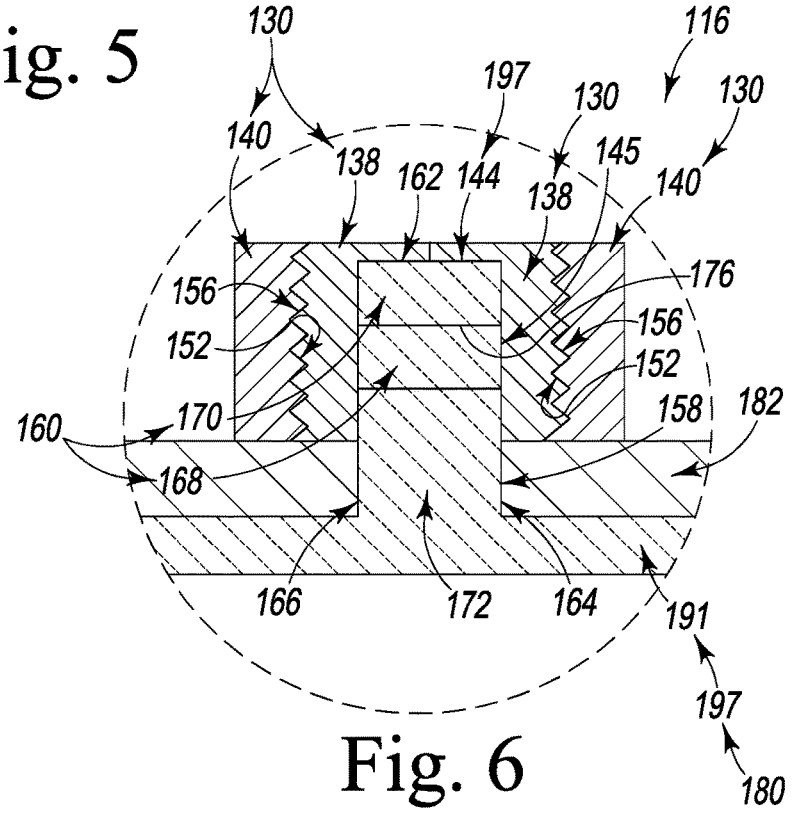
FIG. 6 is a detail view of a portion of the combustor of FIG. 5 showing that the combustor includes a retention system for holding ceramic matrix composite combustor tiles in place relative to a metallic shell.

Referring now to FIGS. 5-6, a combustor 116 of a gas turbine engine 110 illustratively includes a pair of studs 144 and a retention system 130. Specifically, the pair of studs 144 are formed in a liner 180 of the combustor 116, and the retention system 130 is adapted to couple the liner 180 to a shell 182 of the combustor 116 so that the liner 180 is supported by the shell 182.

The combustor 116 includes the shell 182, the liner 180, fuel nozzles 184, and a heat shield 186 as shown in FIG. 5. The shell 182 is constructed from a metallic material and defines an annular cavity 188 that extends around a central axis. The liner 180 is arranged inside the cavity 188 defined by the shell 182 and extends around an annular combustion chamber 192 in which the mixture of compressed air and fuel is ignited to produce the hot, high-pressure gases that drive the gas turbine engine 110. The fuel nozzles 184 are circumferentially arranged around the combustion chamber 192 and provide fuel to the combustion chamber 192. The heat shield 186 is arranged to protect the shell 182 from the hot, high-pressure gases.

The shell 182 of the combustor 116 illustratively includes an outer shell member 194 and an inner shell member 196 that is generally concentric with and nested inside the outer shell member 194. Each of the outer and inner shell members 194, 196 are coupled to the liner 180 as shown in FIG. 5.

The liner 180 of the combustor 116 is illustratively assembled from a plurality of liner tiles 197-200 adapted to extend around a portion of the axis 190. The liner tiles 198-200 are secured to the shell 182 by a plurality of metallic fasteners 195 as shown in FIG. 5. The liner tile 197 is secured to the shell 182 by the pair of studs 144. In the illustrative embodiment, each of the liner tiles 197-200 is constructed from a ceramic matrix composite material. Each of the liner tiles 197-200 is arranged around the circumference of the outer or inner shell members 194, 196. Each of the liner tiles 197-200 includes a body 193 and at least one axially-extending tab 191 arranged along an axially-forward side of a corresponding body 193.

The liner tile 197 illustratively includes the tab 191 and the pair of studs 144 formed in one-piece with the tab 191 that extend radially outward from the tab 191 away from the axis 190. The studs 144 are circumferentially spaced apart from one another about the axis 190, and the studs 144 extend radially outward from the tab 191 and away from the axis 190 parallel to one another. In addition, though each of the liner tiles 198-200 is not shown to include the studs 144, the studs 144 may be included in each of the liner tiles 198-200 and formed in one-piece with the tab 191 of each of the liner tiles 198-200. Furthermore, though only two studs 144 are illustratively formed in the tab 191, more or less than two studs 144 may be formed in the tab 191 of the liner tile 197 or the tabs 191 of the other liner tiles 198-200 in other embodiments.

The shell 182 is illustratively formed to include apertures 189 sized to receive the studs 144 of the liner tile 197 as shown in FIGS. 5-6. The apertures 189 are circumferentially spaced apart from one another about the axis 190 to receive the studs 144. When the liner tile 197 is arranged adjacent the shell 182 to assemble the combustor 116 as shown in FIGS. 5-6, the studs 144 extend through the apertures 189 and outside the apertures 189 beyond the shell 182.

The apertures 189 may be sized to permit the studs 144 to move within the apertures 189 to a limited extent when the studs 144 are received in the apertures 189. As such, the liner tile 197 and the retention system 130 coupled thereto may be movable relative to the shell 182 to the extent the studs 144 are movable within the apertures 189. In other embodiments, however, the apertures 189 may be sized to resist or substantially prevent the studs 144 from moving within the apertures 189 when the studs 144 are received in the apertures 189.

The retention system 130 illustratively includes a pair of threaded stud receivers 138 that capture a portion 145 of the studs 144 arranged outside the apertures 189 to block movement of the studs 144 out the apertures 189. In addition, the retention system 130 includes nuts 140 that engage the threaded stud receivers 138 to block release of the studs 144 from the stud receivers 138. When the liner tile 197 is arranged adjacent the shell 180 to assemble the combustor 116 such that the studs 144 extend through the apertures 189, the threaded stud receivers 138 receive the portion 145 of the studs 144 and the nuts 140 surround and engage the threaded stud receivers 138. The threaded stud receivers 138 and the nuts 140 engage the shell 180 such that the threaded stud receivers 138 and the nuts 140 extend beyond the studs 144 relative to the shell 180.

The retention system 130 and the studs 144 are substantially similar to the retention system 30 and the studs 44, respectively, shown in FIGS. 1-4 and described herein. Accordingly, similar reference numbers in the 100 series indicate features that are common between the retention system 130 and the retention system 30, and also between the studs 144 and the studs 44. The description of the retention system 30 and the studs 44 are hereby incorporated by reference to apply to the retention system 130 and the studs 144, respectively, except in instances when it conflicts with the specific description and drawings of the retention system 130 and the studs 144.

The retention systems (e.g., retention systems 30, 130) may be adapted for use in applications other than the applications discussed heretofore. In some embodiments, the retention systems may be included in seal segments located circumferentially between adjacent segments 32 of the blade track 26. In other embodiments, the retention systems may be included in components of thrust-augmenting devices, such as tiles of augmentors adapted for use in gas turbine engines.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine shroud comprising a carrier made of metal and formed to include an aperture, a blade track segment made of ceramic matrix composite material and arranged adjacent to the carrier, the blade track segment including a runner adapted to extend circumferentially around an axis and a stud formed in one-piece with the runner that extends radially outward from the runner through the aperture formed in the carrier, and a retention system adapted to couple the blade track segment to the carrier, the retention system including a pair of threaded stud receivers that capture a portion of the stud arranged outside of the aperture to block movement of the stud out of the aperture and a nut that engages the pair of threaded stud receivers to block release of the stud from the pair of threaded stud receivers, the pair of threaded stud receivers having a top wall that covers a distal end of the stud, wherein the stud includes a neck that extends through the aperture and a first barb arranged outside the aperture opposite the runner and the first barb extends outward away from the neck to form a retention surface that faces radially inward toward the axis and is tangent to at least a part of a runner surface of the runner.

2. The turbine shroud of claim 1, wherein a first of the pair threaded stud receivers is formed to include a first cutout having a first shape complimentary to a first half of the first barb and a second of the pair threaded stud receivers is formed to include a second cutout having a second shape complimentary to a second half of the first barb, wherein the first cutout and the second cutout are arranged in confronting relation to receive the first barb such that the pair of threaded stud receivers block movement of the stud out of the aperture.

3. The turbine shroud of claim 1, wherein the retention surface extends from the neck at a generally constant distance from the runner.

4. The turbine shroud of claim 1, wherein the first barb extends axially outward from the neck to form the retention surface such that the retention surface faces radially inward toward the axis.

5. The turbine shroud of claim 4, wherein the retention surface extends from the neck at a generally constant distance from the runner.

6. The turbine shroud of claim 1, wherein (i) the carrier is formed to include an additional aperture, (ii) the blade track segment includes an additional stud formed in one-piece with the runner that extends radially outward from the runner parallel to the stud through the additional aperture formed in the carrier, and (iii) the additional stud is circumferentially spaced apart from the stud about the axis.

7. The turbine shroud of claim 6, wherein the stud and the additional stud are sized relative to the aperture and the additional aperture respectively to allow the stud and the additional stud to move within the aperture and the additional aperture respectively so that the blade track segment is movable relative to the carrier.

8. The turbine shroud of claim 6, wherein the stud and the additional stud are sized relative to the aperture and the additional aperture respectively to prevent the stud and the additional stud from moving within the aperture and the additional aperture respectively.

9. The turbine shroud of claim 1, wherein the carrier is formed to include an outer carrier and an inner carrier coupled to the outer carrier, the inner carrier having an inner carrier surface configured to engage the pair of threaded stud receivers and the nut.

10. The turbine shroud of claim 2, wherein the first barb is one of a first pair of barbs extending radially outward from the neck along a barb direction, the stud further including a second pair of barbs extending radially outward from the neck along the barb direction and arranged beyond the first pair of barbs relative to the neck.

11. The turbine shroud of claim 10, wherein a first barb of the first pair of barbs extends in a first direction, and a second barb of the first pair of barbs extends in a second direction opposite the first direction, and wherein a first barb of the second pair of barbs extends in the first direction, and a second barb of the second pair of barbs extends in the second direction.

12. The turbine shroud of claim 11, wherein the stud further includes a planar roof formed between the second pair of barbs and spaced apart from the neck such that each barb of the second pair of barbs extends away from the planar roof to form a pair of barb surfaces having a constant downward slope angle.

13. The turbine shroud of claim 12, wherein the first pair of barbs, the second pair of barbs, the neck, and the planar roof cooperate so that the stud has a fir tree shape.

14. The turbine shroud of claim 2, wherein the first barb, a second pair of barbs, and the neck cooperate so that the stud has a sinusoidal shape.

15. A turbine shroud comprising:

a carrier made of metal and formed to include an aperture, a blade track segment made of ceramic matrix composite material and arranged adjacent to the carrier, the blade track segment including a runner adapted to extend around a part of an axis and a stud that extends radially outward from the runner away from the axis through the aperture formed in the carrier, and a retention system adapted to couple the blade track segment to the carrier, the retention system including a pair of threaded stud receivers that capture a portion of the stud arranged outside of the aperture to block movement of the stud out of the aperture and a nut that engages the pair of threaded stud receivers to block release of the stud from the pair of threaded stud receivers, wherein the pair of threaded stud receivers have a top wall that covers a distal end of the stud.

16. A turbine shroud comprising: a carrier made of metal and formed to include an aperture, a blade track segment made of ceramic matrix composite material and arranged adjacent to the carrier, the blade track segment including a runner adapted to extend around a part of an axis and a stud with a neck that extends radially outward from the runner through the aperture formed in the carrier and a pair of first barbs arranged outside the aperture opposite the runner, and a retention system adapted to couple the blade track segment to the carrier, the retention system including a pair of threaded stud receivers that capture a portion of the stud arranged outside of the aperture to block movement of the stud out of the aperture, the pair of threaded stud receivers having a top wall that covers a distal end of the stud, and a nut that engages the pair of threaded stud receivers to block release of the stud from the pair of threaded stud receivers, wherein a first threaded stud receiver of the pair of threaded stud receivers is formed to include a first cutout having a first shape complimentary to a first half of the pair of first barbs and wherein a second threaded stud receiver of the pair of threaded stud receivers is formed to include a second cutout having a second shape complimentary to a second half of the pair of first barbs and the first cutout and the second cutout are arranged in confronting relation so that the first cutout and the second cutout receive the pair of first barbs such that the pair of threaded stud receivers block movement of the stud out of the aperture, wherein the stud further includes a planar roof formed between the pair of first barbs and spaced apart from the neck such that each barb of the pair of first barbs extends away from the planar roof to form a pair of barb surfaces having a constant downward slope angle, and wherein each barb surface of the pair of barb surfaces terminates at a respective furthest edge of each barb of the pair of first barbs and a respective inner surface extends toward the neck from each respective furthest edge such that each respective inner surface forms an angle with the neck equal to 90 degrees.

* * * * *